US006132078A

United States Patent [19]

Lin

[11] Patent Number: 6,132,078

[45] Date of Patent: Oct. 17, 2000

[54] SLURRY PROVIDING SYSTEM

[75] Inventor: Tsang-Jung Lin, Chungli, Taiwan

[73] Assignee: United Integrated Circuits Corp., Hsinchu, Taiwan

[21] Appl. No.: 09/143,421

[22] Filed: Aug. 28, 1998

[30] Foreign Application Priority Data

Jun. 17, 1998 [TW] Taiwan ..... 87209658

[51] Int. Cl.[7] ..... B01F 15/02; B01F 15/06

[52] U.S. Cl. ..... 366/153.1; 366/155.1; 366/136; 366/144; 451/446

[58] Field of Search ..... 366/153.1, 152.6, 366/142, 136, 137, 155.1, 154.1, 159.1, 182.4, 182.3, 182.2, 182.1, 149, 131, 132; 451/446; 216/93, 89

[56] References Cited

U.S. PATENT DOCUMENTS

| | | | |
|---|---|---|---|
| 4,242,841 | 1/1981 | Ushakov et al. | 366/153.1 |
| 4,762,684 | 8/1988 | Chantriaux et al. | 366/191 |
| 4,850,700 | 7/1989 | Markus et al. | 366/153.1 |
| 5,104,524 | 4/1992 | Eiben et al. | 366/152.6 |
| 5,211,475 | 5/1993 | McDermott | 366/153.1 |
| 5,287,817 | 2/1994 | Lees, Jr. et al. | 110/193 |
| 5,445,193 | 8/1995 | Koeninger et al. | 366/136 |
| 5,511,876 | 4/1996 | Plessers et al. | 366/153.1 |
| 5,632,960 | 5/1997 | Ferri, Jr. et al. | 366/153.1 |
| 5,750,440 | 5/1998 | Vanell et al. | 366/154.1 |
| 5,803,599 | 9/1998 | Ferri, Jr. et al. | 366/191 |
| 5,899,563 | 5/1999 | Karras | 366/152.3 |

*Primary Examiner*—Tony G. Soohoo
*Attorney, Agent, or Firm*—Hickman Stephens Coleman & Hughes, LLP

[57] ABSTRACT

A slurry providing system, located between a main slurry providing system and a CMP machine, includes a providing barrel, which can either be used as a buffer tank to provide slurry to the CMP machine with interruption, or as an independent backup tank for store slurry. The providing barrel also includes an impeller to stir slurry to prevent slurry deposition, and a liquid level sensor to monitor slurry level. The slurry providing system further includes a pump to continuously provide slurry from the providing barrel when the main slurry providing system is down. There is a pressure-regulating valve between the slurry providing system and the CMP machine.

16 Claims, 2 Drawing Sheets

SLURRY PROVIDING SYSTEM

CROSS-REFERENCE TO RELATED APPLICATION

This application claims the priority benefit of Taiwan application serial no. 87209658, filed Jun. 17, 1998, the full disclosure of which is incorporated herein by reference.

BACKGROUND OF THE INVENTION

1. Field of the Invention

This invention relates to a slurry providing system, and more particularly to a slurry providing system that can either act as a buffer tank of slurry to continuously provide slurry to a chemical mechanical polishing (CMP) machine, or as an independent backup tank.

2. Description of Related Art

As the integration of semiconductor devices increases, the size of the metal oxide semiconductor (MOS) transistor is reduced accordingly. This, in turn, increases the requirements for interconnects. Therefore, a design including at least two metal layers is gradually becoming necessary for most integrated circuits. In this kind of design, in order to more easily fabricate devices and more precisely transfer circuit patterns, it is important to planarize the wafer whose surface is usually not level due to the many-layered structures formed on it. Furthermore, planarizing the wafer is the main factor affecting the precision of the alignment. A poor planarization causes imprecise alignment of a mask to the wafer and also induces a higher rate of error in fabrication.

So far, chemical-mechanical polishing (CMP) is the only process capable of globally planarizing a very large scale integration (VLSI) structure or even an ultra large semiconductor integration (ULSI) structure. CMP uses a machine similar to a knife grinder along with a chemical reagent to mechanically grind the uneven profile of the wafer so that it is planarized.

In CMP, the reagent is usually referred to as a slurry. Slurry usually includes a solution mixed with silica in colloidal phase or materials in dispersed phase such as aluminum, KOH or $NH_4OH$. The grinding particles are extremely hard and have a diameter of about 0.1–0.2 $\mu$m. Basically, these particles are used to polish the wafer surface.

Conventionally, slurry used in CMP is provided from a slurry providing system. One slurry providing system usually provides slurry for several CMP machines as shown in FIG. 1. FIG. 1 is a flow chart schematically illustrating a conventional system for providing slurry to several CMP machines.

When performing a CMP process, slurry is continuously provided from a main slurry providing system 10 to several CMP machines, such as CMP machines 12, 14, 16, and 18, through a transportation route represented by the connecting lines.

For the conventional main slurry providing system, if a short circuit or a breakdown occurs on the main slurry providing system 10, the main slurry providing system 10 cannot continue its normal provision of slurry to the CMP machines 12, 14, 16, 18 to polish wafers (not shown). The fabrication online works are therefore interrupted.

Moreover, if the transportation route (line) for transporting slurry is too long, then pressure used to drive the slurry may become insufficient to properly provide slurry to the CMP machines 12, 14, 16, 18. In this case, the CMP machines 12, 14, 16, 18 do not perform as desired and cause fabrication failure. Furthermore, when the main slurry providing system 10 is in an idle stage due to the interruption, slurry then is standstill and is be out as a crystalline deposit (not shown). In this case, if slurry is reused in CMP, the crystalline deposit will scratch wafers (not shown), which are to be polished, causing yet another kind of fabrication failure.

SUMMARY OF THE INVENTION

It is therefore an objective of the present invention to provide a slurry providing system, which takes part in a main slurry providing system operation by serving as a buffer providing tank or a backup tank. The slurry providing system can continue providing slurry when the main slurry providing system is interrupted due to, for example, a short circuit or breakdown so that the fabrication works online are not interrupted.

It is another an objective of the present invention to provide a slurry providing system that takes part in a main slurry providing system operation. The slurry providing system includes a setup to maintain a desired pressure to drive slurry and to prevent a slurry deposition from occurring so that fabrication does not fail due to improper provision of slurry.

In accordance with the foregoing and other objectives of the present invention, a slurry providing system of the invention is used to receive the slurry output of a main slurry providing system and provide slurry to a CMP machine under controlled conditions. The slurry providing system includes a providing barrel, an impeller, and a liquid level sensor. The providing barrel for containing slurry includes an input opening and an output opening, allowing slurry to flow in and flow out. The impeller is located inside the providing barrel to stir slurry so as to avoid a slurry deposition. The liquid level sensor located inside the providing barrel is to monitor the slurry level to determine whether slurry is to be refilled or not.

BRIEF DESCRIPTION OF DRAWINGS

The invention can be more fully understood by reading the following detailed description of the preferred embodiment, with reference made to the accompanying drawings as follows.

DETAILED DESCRIPTION OF PREFERRED EMBODIMENT

Figure 1:
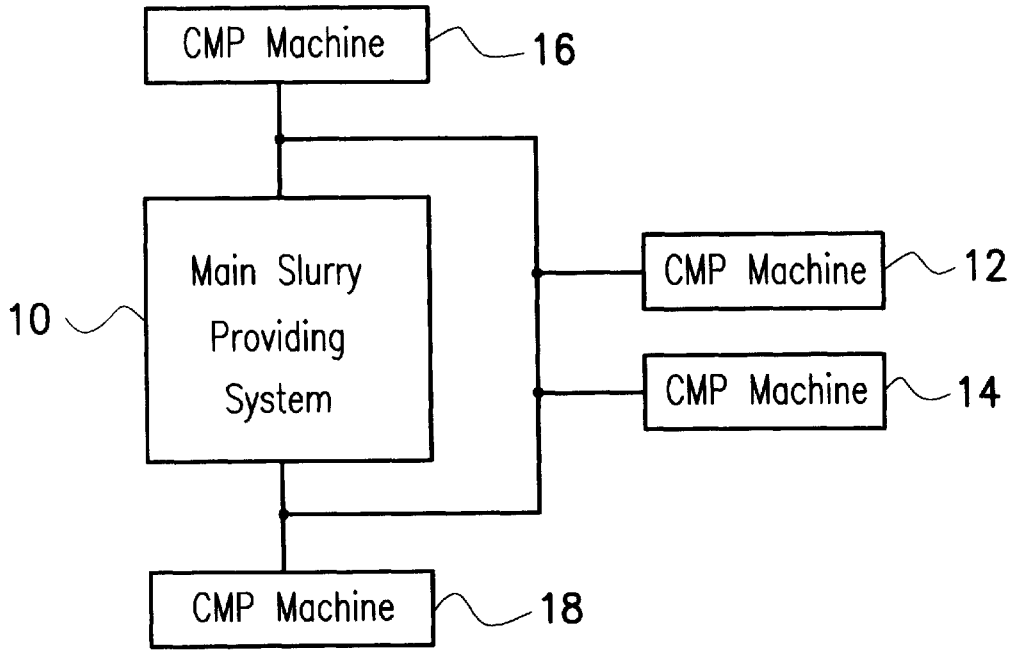
FIG. 1 (PRIOR ART)
FIG. 1 is a flow chart illustrating a conventional system for providing slurry to several CMP machines.
Figure 2:
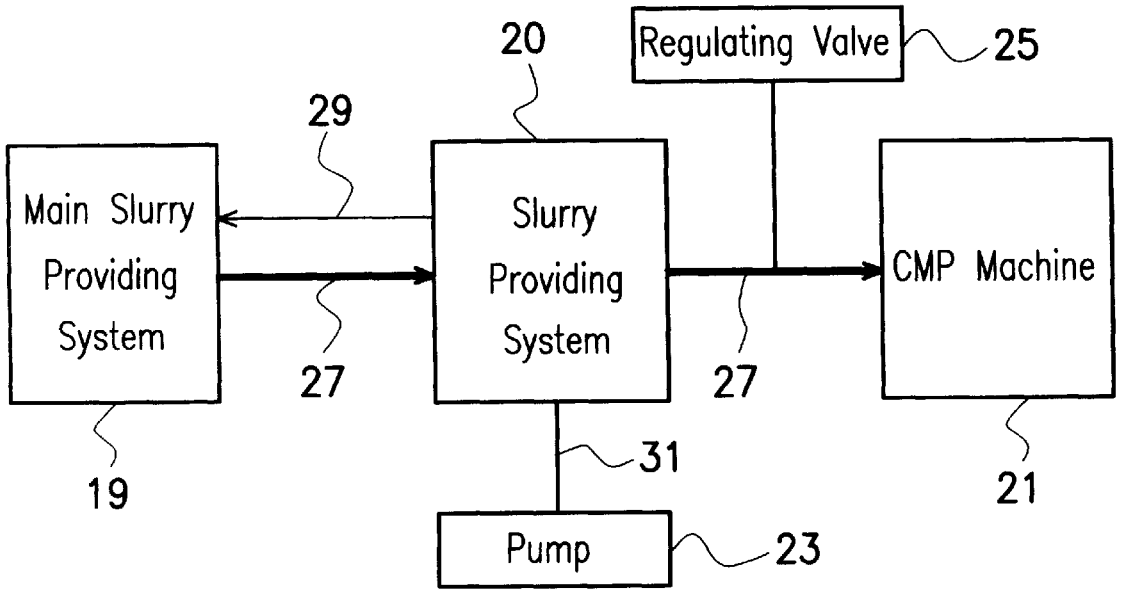
FIG. 2 is a flow chart schematically illustrating a system, according to a preferred embodiment of the invention, for providing slurry to several CMP machines.
Figure 3:
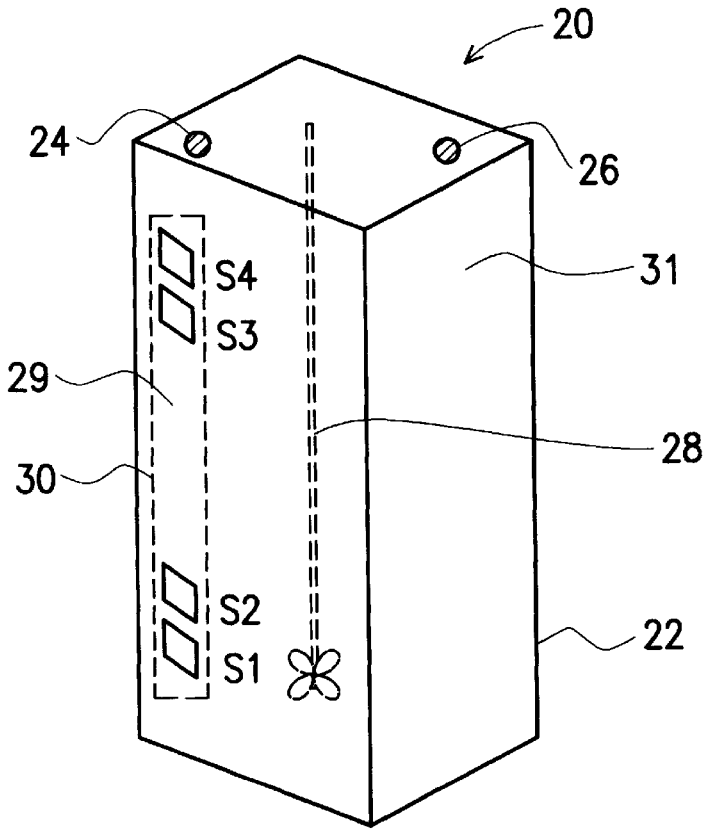
FIG. 3 is a schematic perspective view of a slurry providing system, according to a preferred embodiment of the invention.

FIG. 2 is a flow chart schematically illustrating a system, according to a preferred embodiment of the invention, for providing slurry to several CMP machines. FIG. 3 is a schematic perspective view of a slurry providing system, according to a preferred embodiment of the invention.

In FIG. 2 and FIG. 3, a slurry providing system 20 of the invention receives slurry output from a main slurry providing system 19 and then exports slurry to a CMP machine 21 to polish a wafer (not shown) through a transportation route 27. The slurry providing system 20 is also coupled with a pump 23 through a junction 31. The pump 23 is used to maintain slurry circulation during an interruption of the main slurry providing system 19 due to, for example, a short circuit or a breakdown. A pressure-regulating valve 25 is located between the slurry providing system 20 and the CMP machine 21 to compensate for a shortage of pressure due to the transportation route 27 being too long, which usually occurs between the providing barrel 22 and the CMP machine 21. Slurry thereby can be provided to the CMP machine 21 in a normal rate. The pump 23 and the impeller 28 are kept "on" during the normal mode of operation to maintain slurry circulation and stir slurry, respectively.

Moreover, the slurry providing system 20 includes a providing barrel 22, which has an input opening 24 and an output opening 26, preferably located on the top of the providing barrel 22. Slurry from the main slurry providing system 19 flows through the transportation route 27 and into the providing barrel 22 by way of the input opening 24 and is stored inside as a buffer. Slurry is also exported from the output opening 26 and through the transportation route to the CMP machine 21. Inside the providing barrel 22, there are an impeller 28 and a liquid level sensor 30. The impeller 28 is used to stir slurry so as to avoid a slurry deposition, and the liquid sensor 30 is closely attached to the sidewall.

The liquid level sensor 30 is used to detect the slurry level inside the providing barrel 22 to see whether or not the barrel 22 is properly filled with slurry. The level sensor 30, for example includes a lowest sensor S1 and a second lowest sensor S2 for detecting under-filled situations and a highest sensor S4 and a second highest sensor S3 for detecting over-filled situation. If slurry is properly filled, in which the slurry level is between the second lowest sensor S2 and the second highest sensor S3, then the lower sensors S1, S2 are "on", and the higher sensors S3, S4 are "off".

When slurry level falls below the second lowest sensor S2, the sensor S2 is "off" and the liquid level sensor 30 then sends a request signal to the main slurry providing system 19 through a cable, also called a signal output device, 29 to generate an action of filling the providing barrel 22 with slurry until the second highest sensor S3 is "on". This means that slurry level has reached the height of the second highest sensor S3. The liquid level sensor 30 then sends a stop signal to the main slurry providing system 19 to stop filling.

In the case that the second lowest sensor S2 does not work, the slurry level falls below the lowest sensor S4. The liquid level sensor 30 then sends an alarm reporting the low level to a central control system (not shown) to warn an operator, who can, for example, turn off both the pump 23 and the impeller 28.

Similarly, in the case that the second highest sensor S3 does not work, the slurry level exceeds the highest sensor S4. Then, the liquid level sensor 30 sends an alarm reporting the high level to a central control system to warn an operator, who can, for example, turn off both the pump 23 and the impeller 28.

Figure 4:
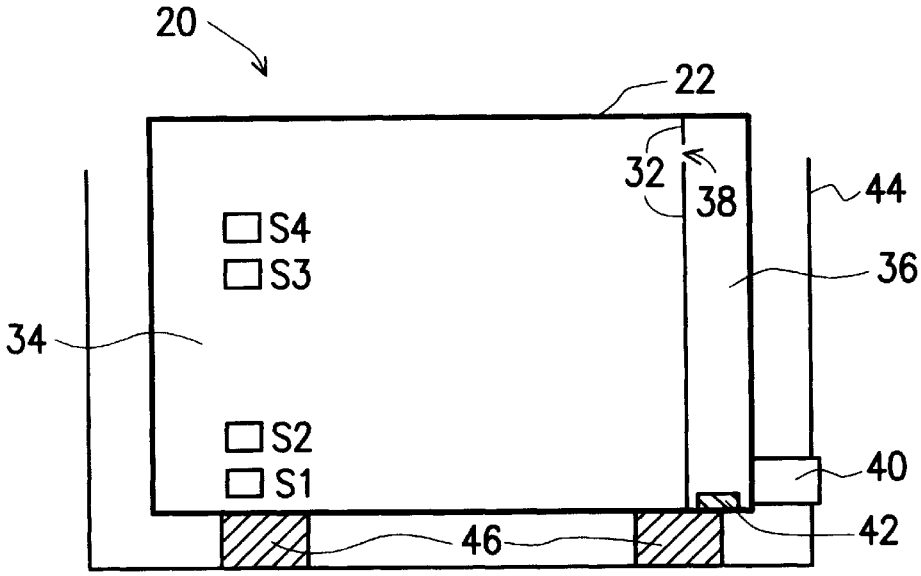
FIG. 4 is a schematic cross-sectional view of the slurry providing system, according to a preferred embodiment of the invention.

FIG. 4 is a schematic cross-sectional view of the slurry providing system, according to a preferred embodiment of the invention. In FIG. 4, a baffle plate 32 divides the providing barrel 22 into a providing region 34 and an overflow region 36. The providing region 34 is larger than the overflow region 36 and includes both the input opening 24 and the output opening 26. The baffle plate 32 has a hole 38 located higher than the highest sensor S4 so that if the highest sensor S4 fails to issue the high alarm, slurry can flow into the overflow region 36 through the hole 38. An ejection duct 40 is located on the bottom sidewall of the overflow region 36. The ejection duct 40 can eject overflowed slurry to a recycle barrel (not shown). Moreover, there is a leak sensor 42 at the bottom of the overflow region 36. As overflowed slurry is detected, a leakage alarm is immediately issued, which also generates an action to automatically interrupt the request signal and stop the operations of both the pump 23 and the impeller 28.

Moreover, an uninterrupted power system (UPS) (not shown) may be included in the slurry providing system 20 to maintain power when the main slurry providing system is off for any reason, such as a short circuit. Thus the CMP machine 21 can still work at a proper slurry-providing rate.

Furthermore, in FIG. 4. the providing, barrel 22 can also be contained in a tub 44. The providing barrel 22 thereby can be heated up by water in the tub 44, which is equipped with a temperature controller (not shown) to heat up water and monitor water temperature. If slurry inside the providing, barrel 22 needs a thermal process to have a better slurry quality. Such as a better slurry reaction rate, then the tub 44 is very suitable to provide such a thermal environment. The providing barrel 22 is supported by a thermal resist pad 46 inside the tub 44. Water then can be filled into the tub 44 and heated up to a desired temperature by the temperature controller. The temperature is also monitored by the temperature controller. The tub 44 and the thermal resist pad 46 include, for example, poly-propylene (PP) or poly-vinyl-chloride (PVC). There is an aperture on the tub 44 that closely matches the ejection duct 40 to allow overflowed slurry to be ejected.

The input opening 24, the Output opening 26, the impeller 28, and the liquid level sensor 30 are all located in the providing region 34 of the providing barrel 22.

According to the preferred embodiment described above, the slurry providing system 20, between the main slurry providing system 19 and the CMP machine 21, can also act as a buffer tank to provide slurry for about 2 to 3 hours when the main slurry providing system 19 is down. The providing barrel 20 can also be independently used as a backup tank.

In conclusion the slurry providing system 20 in the invention has several characteristics as follows:

1. The providing barrel 22 can be used as a buffer or a backup tank to provide slurry to the CMP machine 21 through the pump 23, when slurry cannot be provided by the main slurry providing system 19 due to, for example, a short circuit or a breakdown occur.

2. The impeller 28 is used to stir slurry to prevent a slurry deposition, which may scratch the polished wafer.

3. The liquid level sensor 30 is used to monitor the slurry level inside the providing barrel 22 so that slurry can be controlled at a proper providing status.

4. A pressure-regulating valve 23 is used to maintain a pressure driving force on slurry when the transportation route 27 is too long. Thus, the slurry-providing rate is maintained.

5. The tub 44 is used to provide a thermal environment, which allows a thermal process to be performed on slurry in order to obtain a better slurry quality, such as the slurry reaction rate.

The invention has been described using an exemplary preferred embodiment. However, it is to he understood that the scope of the invention is not limited to the disclosed embodiment. On the contrary it is intended to cover various modifications and similar arrangements. The scope of the claims, therefore, should be accorded the broadest interpretation so as to encompass all such modifications and similar arrangements.

What is claimed is:

1. A slurry providing system used to receive slurry from a main slurry providing system and to export slurry to a CMP machine, the slurry providing system comprising:

a providing barrel used to store slurry, the providing barrel comprising an input opening and an output opening so that slurry can flow in and flow out, and the output opening allows slurry to be exported to the CMP machine, wherein the providing barrel further comprises:

a baffle plate to divide the providing barrel into a providing region and an over-flow region, wherein:

the baffle plate further comprises a hole, which is close to the top of the providing barrel and higher than the liquid level sensor, to allow overflowed slurry to flow into overflow region; and the providing region comprises the input opening, the output opening, the impeller, and the liquid level sensor;

an ejection duct on a bottom side wall of the providing barrel in the overflow region to eject overflow slurry; and a leak sensor on the bottom of the providing barrel to detect whether there is overflow slurry in the overflow region;

an impeller located inside the providing barrel to stir slurry;

a liquid level sensor attached on an inner side wall of the providing barrel to monitor slurry level and determine whether slurry is to be refilled or not; and a pump coupled to the providing barrel so as to maintain a slurry circulation between the providing barrel and the CMP machine even when the main slurry providing system has an interruption.

2. The slurry providing system of claim 1, wherein the slurry providing system comprises a pressure-regulating valve located between the providing barrel and the CMP machine to regulate pressure, which drives the slurry.

3. The slurry providing system of claim 1, wherein the providing barrel further comprises:

a tub to contain the providing barrel and to be filled with water, wherein the tub comprises an aperture tightly matched with the ejection duct, through which aperture the ejection duct penetrates;

a thermal resist pad located on a bottom of the tub to hold the providing barrel; and a thermal controller used to heat water and monitor water temperature.

4. The slurry providing system of claim 3, wherein the tub and the thermal resist pad comprise poly-propylene (PP).

5. The slurry providing system of claim 3, wherein the tub and the thermal resist pad comprise poly-vinyl-chloride (PVC).

6. The slurry providing system of claim 1, wherein the slurry providing system further comprises an uninterrupted power system (UPS) to maintain uninterrupted power.

7. The slurry providing system of claim 1, wherein the input opening is located on the top of the providing barrel.

8. The slurry providing system of claim 1, wherein the output opening is located on the top of the providing barrel.

9. A slurry providing system used to receive slurry from a main slurry providing system and to export slurry to a CMP machine, the slurry providing system comprising:

a providing barrel used to store slurry, in which the providing barrel comprises an input opening and an output opening so that slurry can flow in and flow out;

an impeller located inside the providing barrel to stir slurry;

a liquid level sensor attached on an inner side wall of the providing barrel to monitor slurry level and determine whether the slurry is to be refilled or not; and a pump coupled to the providing barrel so as to maintain a slurry circulation in the providing system between the providing barrel and the CMP machine even when the main slurry providing system has an interruption;

a pressure-regulating valve located between the providing barrel and the CMP machine to regulate pressure, which drives the slurry;

a tub to contain the providing barrel and to be filled with water;

a thermal resist pad located on the bottom of the tub to hold the providing barrel; and a thermal controller used to heat water and monitor water temperature.

10. The slurry providing system of claim 9, wherein the tub and the thermal resist pad comprise poly-propylene (PP).

11. The slurry providing system of claim 9, wherein the tub and the thermal resist pad comprise poly-vinyl-chloride (PVC).

12. The slurry providing system of claim 9, wherein the slurry providing system further comprises an uninterrupted power system (UPS) to maintain uninterrupted power.

13. The slurry providing system of claim 9, wherein the providing barrel comprises:

a baffle plate to divide the providing barrel into a providing region and an overflow region, wherein:

the providing region comprises the input opening, the output opening, the impeller, and the liquid level sensor; and the baffle plate further comprises a hole, which is close to a top of the providing barrel and higher than the liquid level sensor, to allow overflow slurry to flow into the overflow region;

an ejection duct penetrating through an aperture in a bottom side wall of the providing barrel in the overflow region to eject overflow slurry; and a leak sensor on the bottom of the providing barrel to detect whether there is overflow slurry in the overflow region.

14. The slurry providing system of claim 9, wherein the input opening is located on the top of the providing barrel.

15. The slurry providing system of claim 9, wherein the output opening is located on the top of the providing barrel.

16. The slurry providing system of claim 9, wherein the liquid level sensor further comprises a function to detect whether or not the slurry providing system is out of an upper limit or a lower limit of design and trigger a warning action.

* * * * *